US006901612B2

(12) United States Patent
Calfas et al.

(10) Patent No.: US 6,901,612 B2
(45) Date of Patent: Jun. 7, 2005

(54) CARRIER FOR A PHYSICALLY CHALLENGED PERSON

(76) Inventors: William Calfas, 835 Toulon Dr., Pacific Palisades, CA (US) 90272; Karin A. Calfas, 835 Toulon Dr., Pacific Palisades, CA (US) 90272

( * ) Notice: Subject to any disclaimer, the term of this patent is extended or adjusted under 35 U.S.C. 154(b) by 63 days.

(21) Appl. No.: 10/615,462

(22) Filed: Jul. 7, 2003

(65) Prior Publication Data

US 2005/0005351 A1 Jan. 13, 2005

(51) Int. Cl.[7] ..... A61G 7/10; A61G 7/14
(52) U.S. Cl. ..... 5/81.1 T; 5/627; 294/140
(58) Field of Search ..... 5/81.1 T, 81.1 R, 5/627, 625; 297/183.6; 294/140

(56) References Cited

U.S. PATENT DOCUMENTS

| | | | | | |
|---|---|---|---|---|---|
| 450,835 | A | * | 4/1891 | Darrow | 297/183.6 |
| 675,409 | A | | 6/1901 | Petee | |
| 1,207,750 | A | | 12/1916 | Gwin | |
| 1,281,385 | A | | 10/1918 | Johnson | |
| 1,328,832 | A | * | 1/1920 | Hanrath | 294/140 |
| 1,849,864 | A | | 3/1932 | Caspar | |
| 2,379,365 | A | | 6/1945 | Levison | |
| 3,271,796 | A | | 9/1966 | Dillman | |
| 3,859,677 | A | | 1/1975 | Nordwig | |
| 5,161,275 | A | * | 11/1992 | Simpson et al. | 5/627 |
| 5,317,770 | A | | 6/1994 | Sakurai | |
| 5,422,821 | A | * | 6/1995 | Allen et al. | 700/219 |
| 5,515,549 | A | | 5/1996 | Wang | |
| 5,579,546 | A | * | 12/1996 | Griskauskas | 5/81.1 T |
| 6,250,713 | B1 | * | 6/2001 | Grohs et al. | 297/183.6 |
| 6,532,610 | B1 | * | 3/2003 | Calfas et al. | 5/626 |
| 6,715,167 | B2 | * | 4/2004 | Wake | 5/81.1 T |

FOREIGN PATENT DOCUMENTS

| | | |
|---|---|---|
| NL | 2672 | * 11/1918 |
| WO | WO89/07430 | 8/1989 |

* cited by examiner

*Primary Examiner*—Alexander Grosz
(74) *Attorney, Agent, or Firm*—Donald D. Mon

(57) ABSTRACT

A foldable carrier to transport a person in a seated posture. The carrier has a bottom panel, two side panels, and a back panel. On the outside of the two side panels are at least one rank of anchors, preferably two, to which handles can be engaged to assist lifting the person in the carrier.

8 Claims, 2 Drawing Sheets

CARRIER FOR A PHYSICALLY CHALLENGED PERSON

FIELD OF THE INVENTION

A conveniently stored and erected carrier for physically challenged persons to enable them to be carried from places of endangerment, or to a more desirable location over a path which might otherwise present a formidable obstacle, and to provide to the person reassurance that, when in danger, a means to facilitate his rescue is in his custody.

BACKGROUND OF THE INVENTION

The accommodation of physically challenged persons in public facilities has been well-advanced by legislation and societal pressure. Enablement of access and ready use of buildings, restaurants, theaters, and rest rooms are observable everywhere, as is the removal of barriers such as ledges, curbs and the provision of ramps and elevators.

The key to all of this is the visibility of the problem and the sympathetic understanding of others who do not share the disability. As a consequence of cooperation between these groups, these particular matters have been immeasurably improved.

There remain, unsolved and unseen, many problems frequently experienced by many physically challenged persons which, precisely because they are unseen, and because their events are less frequent, have not received societal attention and correction. In fact, their existence is not brought to anyone's attention, such as by placards informing persons that a ready means for evacuation by physically challenged persons is not available. Because of their unobtrusive nature (to others) they are unlikely to, and it becomes the function of individuals such as inventors and interested companies to devise means which can at least reduce risk and facilitate the movement and safety of physically challenged persons who find themselves in stressful or dangerous situations.

For example, physically challenged persons who have no control over or sufficient strength in their legs, thereby lacking self-locomotion, must rely on supports such as wheel chairs for routine movement. So long as they are safely in the chair and the chair is in safe circumstances, there is no problem.

But what if the person in that chair is on an upper floor in a tall building, the building is on fire, or there is an earthquake or terrorist event, and the elevators cannot be used? The wheel chair then is worse than useless. There is no means for the person to use the chair to escape, and the task of being carried either in it, or separately from it is often impossible because there is no ready means to engage and carry the chair or person, even if there are people right there who are willing to do so if they had the physical capability for the task. Persons who are physically sufficient for this task are few, and it cannot be assumed that any of them will necessarily be present when they are needed.

A physically challenged person inherently worries when he or she goes above the first floor of a building. The assurance of access provided by law and by way of friendly inclination provide for access, but not for quick evacuation from very dangerous buildings, such as one on fire. One means to alleviate this concern is to provide a device according to this invention which is economically affordable, and which can be kept in an office or apartment without taking up much room. An office can readily afford to have a few of these devices on its shelf, and these devices enable reasonably fit people to carry the person out of harm's way. In fact, in some of its alignments only one person is needed, and the person carrying can have a free hand to hold a side rail.

While the term "physically challenged" as used this far relates primarily to persons with nearly total loss of locomotion, there are many others where this invention is useful. Persons who use walkers, persons with Alzheimers, and pregnant women, are unable rapidly to descend steep stairways. They suffer from the same needs as those more challenged, and have the same concerns.

There is yet another example of a use of one of the alignments of this invention—the carrying from harm's way of an injured soldier by two of his fellows. Very often both hands of the two men carrying the injured person are fully involved with carrying the wounded, such as by the "cross arm" carry of two men whose arms there by form a cradle. This makes the three of them a target without defensive capacity. In one alignment of this device, each of the two men carrying the wounded will have a free hand with which he can shoot, however inaccurately, and the wounded might also be able to fire a weapon. However inaccurate their aim might be, they will still be able to keep some hostile heads down.

The above may reasonably be regarded as ultimate problems. With respect to their seriousness, as extremes they overlook more usual and less dramatic, but still disturbing situations. These other situations lack only the ultimate risk of immediate death. Still, to a person exposed to them, or who is reasonably fearful of them, the anticipation of perils, injury and delay of succor are troubling in the extreme. A challenged person in a hotel room who hears the fire alarm ring is panicked, even if the alarm is a false one, as so often happens. The knowledge that a convenient means to affect his or her evacuation is at hand is very quieting even when there is no alarm. The person will have brought the device with him.

The perils attending the fall of a physically challenged person are discussed in applicant's U.S. Pat. No. 6,532,610, which issued Mar. 18, 2003. This patent particularly addresses the problem of raising a person who has fallen to the floor and does not have the ability to raise himself or herself. It also considers the problem of lifting and conveying the raised person to a different location.

The principal problem addressed in the said patent is the avoidance of injury to the person being raised, and also to the persons raising him or her. A frail, fallen person often is injured by the most careful paramedic who must hold him or her while lifting the person. Broken ribs are a frequent complication.

In addition, and especially in residences for the elderly, very high workers compensation insurance rates reflect the potential for damage to the backs of attendants who attempt to lift the person. As a consequence, there is a frequent refusal by these people to raise the person. Instead they leave the person in place and await the arrival of paramedics to lift the person. Their back is saved, and their employer's insurance is spared, but the fallen person still suffers. This situation also pertains in senior care homes, nursing homes, and to senior caregivers in private residences.

This invention is not intended to be a solution to the above problems, although it can be so used. Instead, it is principally directed toward the safe and expedient conveyance of a physically challenged person already prepared for movement, away from a place of peril or disadvantage, or even to a better and more enjoyable place to be.

This does not always means such ultimate events as fleeing from a fire. There are often less baleful events, but of serious mien. The most benign may be the safe transport of a person from a car or wheel chair up or down a long set of stairs while there is not active emergency or even from a chair to a bed, or reverse. Another may be the carriage of an injured fisherman away from his place of injury.

As to this latter situation, persons who fish in distant streams often hike several miles to a good stream from a drop-off location. Then while in the stream they slip on the rocks and sprain an ankle or break a leg. The task is now to get them back to the drop-off location.

Sometimes they can hobble back. Other times they must rely on their companions to carry them, or wait for a crew to come for them. Except for his accident, he is not disabled in the sense of a person with a spinal injury but he is definitely physically challenged. In short, this invention provides for the safe transport of a person who, without it, must either perish in place, or somehow crawl to help.

This same situation pertains to hikers and back packers as well as to fisherman. They often are 12 to 20 miles from succor.

Similarly, a wounded or otherwise injured person can be carried expeditiously.

Persons who have had little or no experience with moving physically challenged persons will have difficulty recognizing the comparative effort needed to lift the person as compared to moving them sidewardly or lowering them. When a person is already elevated, it takes much less effort to keep them that high, or to lower them, but much more effort to raise them. This invention overcomes much of the stress in lifting a person, and provides greater stability while lowering the person.

It is yet another object of this invention to provide a carrier which can be left under the person on top of or beneath a seat cushion where it will be available when the time comes to move the person. At that time it can be quickly erected and the person moved.

It is the object of this invention to provide a convenient, portable device that can be assembled to a person, which provides apparatus employable by others to raise and move the person, either by hand or by suspension from the torso of the care-giver. It also provides a wide range of alignments to facilitate various modes and circumstances of carrying a person.

BRIEF DESCRIPTION OF THE INVENTION

A carrier according to this invention comprises a foldable sheet having a seat panel, a pair of lateral side panels, and a back panel, said side panels and back panel when assembled in the erect configuration of the device being contiguous or adjacent to a respective edge of the seat panel. The back panel may be contiguous and continuous with either the seat panel or with one of the side panels. Each of said side and back panels has a terminal edge, which, when they are erected become their upper edges. A fastener or fasteners will join some adjacent free edges to form said panels into a seat for an occupant when the panels are erected to form the structure.

According to an optional feature of the invention, a second rank of anchors is provided on each of the side panels, spaced below the rank adjacent to the upper edge.

According to this invention, a plurality of anchors is provided in a first rank adjacent to the upper edges of each of the side panels so that a person in the carrier can readily be lifted by handles engaged to the anchors.

According to still another optional feature of the invention, a shoulder loop is attachable to at least one of the side panel edges so that part of the weight can be supported on the torso of a helper. A pair of such shoulder loops can be provided, one on each side, for two persons to carry, or for one person to carry piggy back, using one loop on each shoulder.

According to still another preferred but optional feature of the invention, a front panel is formed on the edge of the seat panel remote from the back panel, which includes an anchor on its edge remote from the back panel for attachment of a handle to enable the front panel to be raised and if desired pulled to move the occupant forwardly toward a preferred location.

The above and other features of this invention will be fully understood from the following detailed description and the accompanying drawings, in which:

DETAILED DESCRIPTION OF THE INVENTION

Figure 1:
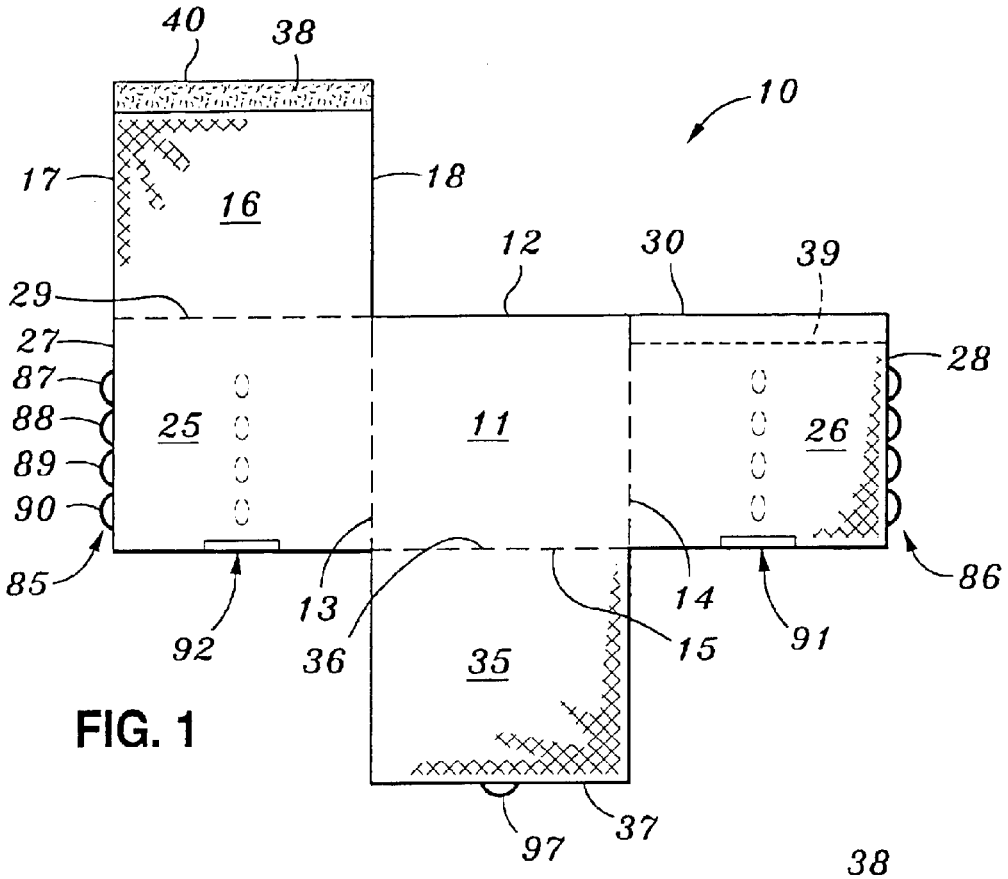
FIG. 1 is a plan view of a carrier according to the invention.
Figure 2:
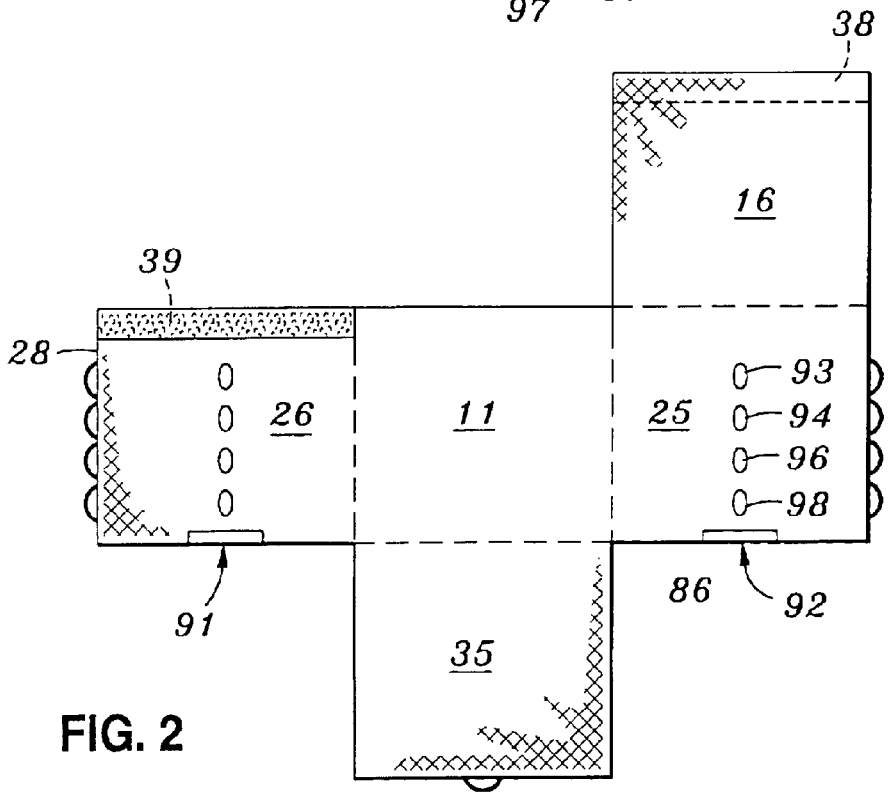
FIG. 2 is a bottom view of FIG. 1.

FIG. 1 shows a plan view of the presently preferred embodiment of a carrier 10 according to this invention, laid out flat. It is preferably made entirely of flexible material, but if preferred may include areas which are stiffened or even rigid. The most useful and convenient carrier will be made of a strong flexible cloth such as light weight canvas. It can even be made entirely of a net material if preferred, or an open weave of washable plastic fiber. Flexible material will be preferred for many uses, because it can be folded or rolled into a small sized-body that can be carried and stored in the same sense as a first-aid kit. For example it may be stored in an office in a high rise building to be used in case of a fire or other need to evacuate injured or challenged persons. It is the kind of product which can accompany the person to give him or her the comfortable feeling that in an event of necessity, he or she will have the means to enable his or her removal.

Carrier 10 includes a seat panel 11 with a back edge 12, parallel side edges 13, 14, and a front edge 15.

A back panel 16 includes what will become a top edge 17, and a bottom edge 18.

Side panels 25, 26 are joined to the seat panel at opposite side edges 13, 14, Each has an upper edge 27, 28, and a rear edge 29, 30 both respectively.

An optional front panel 35 has a rear edge 36 joined to front edge 15 of the seat panel, and a front edge 37.

This is the simplest embodiment of the invention, and the readiest to erect. It is a single piece of material, erected by folding it at the various intersections of the panels. In this embodiment, folds are made at intersections 13, 14 and 29.

When a front panel is provided, it will fold relative to the seat panel at edge 15.

To form the seat structure, attachments 38 and 39 are placed on edges 40 and 30 of panels 16 and 26. These preferably are strips of hook and loop fabric, often called VELCRO, which when engaged are tightly held together as shown in FIG. 3.

Figure 3:
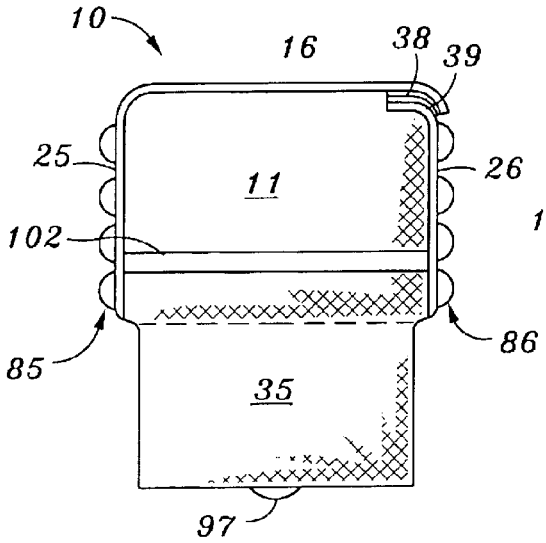
FIG. 3 is a top view of the carrier of FIG. 1, erected.
Figure 4:
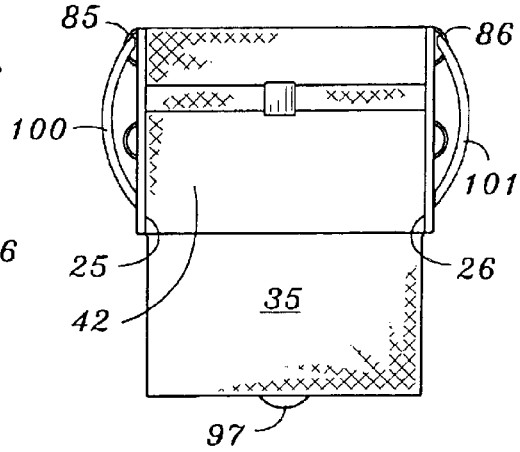
FIG. 4 is a bottom view of FIG. 3 with front panel 35 folded down.

FIGS. 3 and 4 show the erected configuration, wherein the raised side and rear panels form a cavity 42 open at the front in which a person can be supported. In practice, the person will have been placed on the carrier when flat, and the panels brought up next to him.

FIG. 4 looks into the erected carrier, with front panel 35 folded down, as it would be when the carrier is occupied and the person is carried with his legs dangling.

Figure 5:
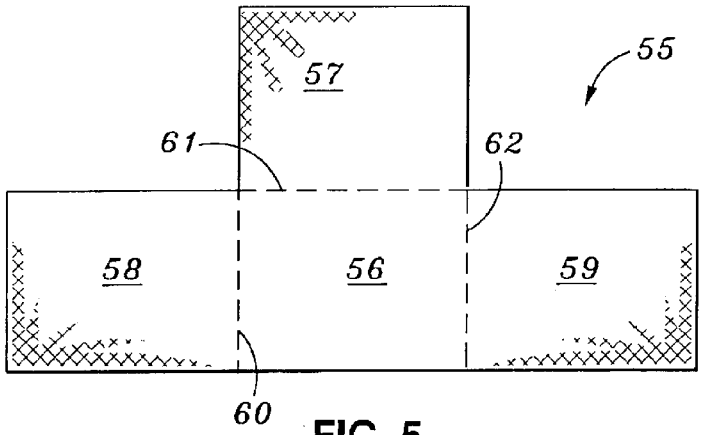
FIG. 5 is a plan view of another embodiment of the carrier.

FIG. 5 shows a somewhat simpler embodiment of carrier 55. Again it is a single unitary piece of suitable material. It includes a seat panel 56, a back panel 57 and side panels 58, 59. The side and back panels can be folded up along fold lines 60, 61 and 62 to form a cavity. Attachments (not shown) can hold the adjacent edges together as in FIG. 1, strips of VELCRO being preferred.

The panels can all be folded relative to one another at their joined edges so that the carrier can be folded into a small bulk for ready carrying when not in use. If all of the panels are flexible, the carrier can be rolled up or folded to a smaller envelope size.

In use, the side and back panels are folded up to form a seat for a person. While various kinds of fasteners can be used to join adjacent edges of the erected side and back panels, including snaps, slide fasteners and buttons, attachment is only necessary at the upper edges. Merely joining the adjacent corners will create a necessary seat, although a more continuous attachment such as Velcro strips will be preferred. All such arrangements are contemplated in this invention.

All embodiments of this invention are intended for convenience of storage and for temporary placement between times when a person is to be moved. Also, they are intended to include features which enable readier and more convenient lifting, carrying, and lowering of a person held in it.

This is accomplished by providing means to engage or to get ahold of the carrier, and to lift or hold it when engaged to the person.

The simplest engagement devices are loops or arches integrated into the carrier itself. A more rugged and often more desirable arrangement is handles that are separably engageable to anchors that are integrated into the carrier. All of the above are collectively called "engagements". More durable and stronger carriers will generally provide strong anchors firmly attached to panels, and handles or loops which will be attached to them by clips. Less durable carriers may use attachments on the panels which themselves can be used as handles, or as anchors for the ends of loops. Design and intended usage criteria will determine which kind of structure to use.

FIG. 5 differs from the embodiment of FIG. 1 in that it requires joinders at two sets of edges, rather than only one.

Figure 6:
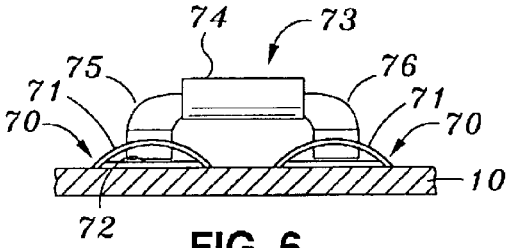
FIG. 6 is a fragmentary view of a handle for the carrier.

The most elegant and ruggedest engagement is shown in FIGS. 1–4. In this embodiment, anchors (sometimes called "engagements") in the form of metal rings are firmly and permanently attached to the carrier at selected locations. FIG. 6 shows two such anchors 70, each of which comprises a metal ring 71 held in place by a fabric band 72 that is strongly sewed to the carrier. Thus this ring can be pressed flat against the carrier or pulled out for engagement by a next assembly such as a handle end or the end of a loop.

FIG. 6 also shows one such handle 73. It includes a central grip 74, which may be quite rigid, and on each end, a reliable clip 75, 76 which will engage the ring. Now the handle can be used to lift or carry the loaded carrier.

Figure 7:
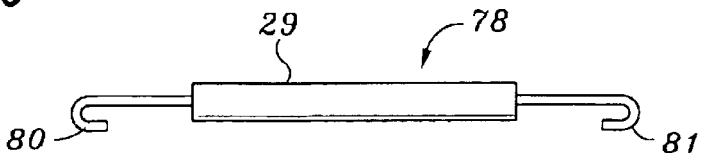
FIG. 7 is a flat view of a shoulder loop for use with the carrier.

Instead of, or in addition to a handle, a shoulder loop 78 (FIG. 7) has a central flexible length 29 and a releasable clip 80, 81 at each end.

By attaching the handle or loop to anchors as yet to be described, the carrier can conveniently be supported by a helper person. Notice that such a handle or shoulder loop can be attached to any selected pair of anchors, so that lifting force can be exerted in selected, convenient locations.

A first rank 85, 86 of anchors is attached to each side panel or on adjacent to its respective edge which will be uppermost when the carrier is in its erect condition. While more or fewer of these anchors can be provided, four of them will provide for a useful variety of modes of carriage.

For example, rank 85 has four anchors 87, 88, 89 and 90. Any two of these can be bridged by a handle such as shown in FIG. 6. If desired, two handles can be applied, one forwardly of the other.

An optional second rank 91, 92 is provided on the outside of the side panels, spaced well below the upper edge, where it will provide for lift below the upper edge and above the seat panel. For example, second rank 92 has four anchors 93, 94, 98 and 96. These enable one to place a handle at a lower elevation instead of (or in addition to) the upper rank. When carrying a very heavy person, or if the height to which the carrier is to be lifted is substantial, a lower "grip" on the carrier will be preferred.

Carrying a person using only handles for a considerable distance can be tiring. To alleviate this situation, a shoulder loop 78 (FIG. 7) can be attached to any of the anchors, and in particularly to two anchors on one side panel. They may be permanently attached, or can be detachably secured.

Front panel 35 offers a significant advantage when the person must be moved while in the carrier, but while sitting or laying down. A handle 97, similar to the side handles is attached (or detachably attached) to the front edge of the front panel. Then, with the person's legs atop this panel, the person can be pulled forwardly. If desired, the front panel can be detachably attached to the seat panel.

Instead of separable handles, the handles may be permanently incorporated in the structure This will be most advantageous in lighter-weight one time usage devices. Then, two spaced apart anchors may be permanently connected by a flexible, cloth handle which will collapse to a small shape. In fact, it may be preferred for use in a chair, because it will remain available at all times, and can itself provide not only a handle, but also means for attachment of a loop. When permanently installed "handles" are provided, they also are provided in ranks as before.

For simplicity in disclosure, engagements have not been shown in FIG. 5. They will be provided as desired, just as the embodiment of FIG. 1.

The modes of carrying or lifting the person are many and varied. In the simplest mode, two handles are provided on each side panel, and the person can be lifted by two people.

For more extreme situations, a loop may be formed at one side to be placed over the shoulder of a caregiver, and he can use one hand on a handle. This can be done on both sides for two caregivers. Then each has a spare hand to attend to other matters, such as shooting a gun. So can the person being carried. Or one of the persons can hold a rail with his free hand.

For piggy back carriage, a shoulder loop is formed at each side panel. The caregiver backs into the person being carried, places a loop over each shoulder, and then carries the person behind and "on" him.

When a higher lift is necessary, the same arrangements can be made, using the second (lower) rank of anchors.

Occupant grips 100, 101 can be formed as loops at the formed ends of the side panels. This gives the person a sense of stability. Also, a seat belt 102 can be provided between the side panels, detachably attached at one or at both of its ends.

The versatility of this device will be appreciated from the foregoing.

The use of this device will be evident from the foregoing. The person is somehow placed on the seat, perhaps by rolling him or her to one side and putting it in place, or by boosting him and sliding it under him, and then raising him at the hips. The back and side panels are next raised and the panels are joined. Then, using the handles and/or the loops, the person is raised and carried.

This invention thereby provides a light weight, convenient device for raising and carrying a physically challenged person. The orderliness of the lifting arrangement is such as to protect the backs of the persons doing the lifting. It enables fallen or incapacitated persons to be moved safely for all concerned.

It also frees persons from anxiety, who are slow to move, or bound to a walker or wheel chair. Stair treads are very narrow compared to the base of a walker, and pregnant women often cannot see them anyway. This device enable a person safely and expeditiously to be carried down stairs. Further, he or she knows it is available.

This invention is not to be limited by the embodiments shown in the drawings and described in the description, which are given by way of example and not of limitation, but only in accordance with the scope of the appended claims.

We claim:

1. A carrier for a physically challenged person comprising:

a seat panel having forward, back and side edges;

a back panel having a bottom edge, an upper edge, and a pair of side edges;

a pair of side panels, each side panel having a bottom edge engaged to a respective side edge of said seat panel, and an upper edge;

a plurality of anchors on each side panel adjacent to its respective upper edge, and spaced apart from one another to form a first rank;

a second rank of anchors on each side panel spaced from said first rank and farther from said upper edge than said first rank;

said panels being so interconnected that said side and back panels may be placed substantially normal to said seat panel and maintained in that configuration as the consequence of joining at least one pair of panels at adjacent edges; and a handle extending between at least one pair of said anchors to provide means for lifting the carrier when it is occupied.

2. A carrier according to claim 1 in which said handle is detachably attached to respective said anchors.

3. A carrier according to claim 1 in which said handle is permanently attached to said anchors and is flexible.

4. A carrier according to claim 1 in which each said rank includes at least three said anchors to provide for multiple placements of said handle along said rank.

5. A carrier according to claim 1 in which a stabilizer loop is fixed to each of the side panels adjacent to one of its edges to be held by an occupant in the carrier.

6. A carrier according to claim 1 in which a shoulder loop is provided which comprises a flexible length with two ends, and a clip on each of said ends releasably engageable to a pair of said anchors to form a loop to pass over the shoulder of a caregiver.

7. A carrier according to claim 1 in which all said panels are flexible.

8. A carrier according to claim 1 in which all said panels are formed in a continuous structure, adapted to be folded at their respective intersections to be erected to form a cavity that receives a person to be carried.

* * * * *